US012662297B2

(12) United States Patent
Steedman et al.

(10) Patent No.: US 12,662,297 B2
(45) Date of Patent: Jun. 23, 2026

(54) COVER

(71) Applicant: Cargowise Global Ltd, Andover (GB)

(72) Inventors: Michael Steedman, Andover (GB); Russell East, Andover (GB); Darby Steedman, Andover (GB); Sebastian Steedman, Andover (GB)

(73) Assignee: Cargowise Global Ltd, Andover (GB)

( * ) Notice: Subject to any disclaimer, the term of this patent is extended or adjusted under 35 U.S.C. 154(b) by 0 days.

(21) Appl. No.: 18/828,684

(22) Filed: Sep. 9, 2024

(65) Prior Publication Data

US 2025/0178810 A1 Jun. 5, 2025

(30) Foreign Application Priority Data

Nov. 30, 2023 (GB) ..... 2318348

(51) Int. Cl.
*B65D 71/06* (2006.01)
*B65D 71/00* (2006.01)

(52) U.S. Cl.
CPC ..... *B65D 71/063* (2013.01); *B65D 71/0088* (2013.01); *B65D 2571/00228* (2013.01); *B65D 2571/00703* (2013.01); *B65D 2571/00722* (2013.01); *B65D 2571/00839* (2013.01)

(58) Field of Classification Search
CPC ..... B65D 2571/00839; B65D 2571/00722; B65D 2571/00703; B65D 2571/00228; B65D 71/0088; B65D 71/063
USPC ..... 206/597
See application file for complete search history.

(56) References Cited

U.S. PATENT DOCUMENTS

| | | | | |
|---|---|---|---|---|
| 2011/0226655 | A1* | 9/2011 | Seagle | B65D 19/18 206/521 |
| 2013/0075408 | A1 | 3/2013 | Childress et al. | |
| 2016/0176608 | A1* | 6/2016 | Rick | B65D 77/0413 206/523 |

FOREIGN PATENT DOCUMENTS

| | | | | |
|---|---|---|---|---|
| DE | 202007014283 | U1 | 1/2008 | |
| EP | 3 199 467 | B1 | 6/2018 | |
| GB | 1531581 | A | 11/1978 | |
| IT | MI2011493 | A1 | 2/2013 | |
| WO | WO-2021089420 | A1 * | 5/2021 | B65D 19/38 |

OTHER PUBLICATIONS

Combined Search and Examination Report for corresponding Application No. GB2318348.6, dated Jan. 26, 2024, 7 pages.
Extended European Search Report in corresponding EP Application No. 24195353.8, dated Feb. 10, 2025, in 8 pgs.

* cited by examiner

*Primary Examiner* — Anthony D Stashick
*Assistant Examiner* — L Kmet
(74) *Attorney, Agent, or Firm* — Dority & Manning, P.A.

(57) ABSTRACT

A cover for covering goods supported on a base platform such as a pallet. The cover has an upper panel and a plurality of side panels to define an enclosure surrounded by said plurality of side panels. Each side panel is formed from a sheet material and comprises a reinforcing mesh extending at least partially over the sheet material.

20 Claims, 10 Drawing Sheets

COVER

CROSS-REFERENCE TO RELATED APPLICATIONS

The present application is based upon and claims the right of priority to GB Patent Application No. 2318348.6, filed Nov. 30, 2023, and EP patent application Ser. No. 24/195, 353.8, filed Aug. 20, 2024, the disclosure of which is hereby incorporated by reference herein in its entirety for all purposes.

FIELD

The present teachings relate to a cover for covering goods supported on a base platform such as a pallet.

BACKGROUND

Companies who manufacture goods for use in commerce typically package and ship the items on pallets. These goods are transported around the world via vehicles and/or aircraft on shipping pallets that are typically constructed from wood, plastic, or metal. Goods shipped on pallets are often covered and protected with strapping, stretch wrap, shrink wrap, or a cover and shipped. When these pallets and goods are loaded onto vehicles or aircraft outdoors, adverse weather conditions such as rain or snow may be present and may result in moisture damaging the goods. Another potential issue is that during transportation of the goods there is the risk that the goods may be interfered with, for example damaged or stolen, by someone during transportation.

The present teachings seek to overcome or at least mitigate one or more problems associated with the prior art.

SUMMARY

According to a first aspect of the invention there is provided a cover for covering goods supported on a base platform such as a pallet.

The cover may comprise an upper panel and a plurality of side panels, each of which may extend from an edge of the upper panel to define an enclosure surrounded by said plurality of side panels.

Each side panel may be formed from a flexible sheet of material or a sheet material.

Each side panel may comprise a reinforcing mesh which may extend at least partially over the sheet material. Advantageously, the mesh reinforces the side panels of the cover, which helps to prevent people from cutting open the side panel and accessing the goods covered by the cover. Put another way, the reinforcing mesh helps to provide a side panel that is cut resistant or slash resistant.

Each side panel may comprise one or more regions where the reinforcing mesh is not attached to the sheet material. Each side panel may comprise one or more regions where the reinforcing mesh is moveable relative to the flexible sheet material. Each of the one or more regions are regions in which the reinforcing mesh is not attached to the flexible sheet material. The movement of the reinforcing mesh relative to the sheet material may be in a direction substantially perpendicular to the inner and/or outer surface of the sheet material.

This provides one or more regions where the reinforcing mesh may be considered to float relative to the sheet material. Movement of the reinforcing mesh relative to the sheet material makes the side panel more difficult to cut open, thereby helping to prevent people from cutting open the side panel and accessing the goods covered by the cover. Put another way, movement of the reinforcing mesh relative to the sheet material helps to provide a side panel with improved cut resistance or slash resistance.

The reinforcing mesh may be connected to the flexible sheet material at or near to opposing edges of the flexible sheet material and a region where the reinforcing mesh is moveable relative to the flexible sheet material is defined therebetween.

The reinforcing mesh may be connected to the flexible sheet material at or near to: upper and lower edges of the sheet material and/or first and second side edges of the sheet material.

The reinforcing mesh may be connected to the flexible sheet material in a pattern which defines a plurality of separate regions in which the reinforcing mesh is moveable relative to the flexible sheet material.

The side panels may comprise an inner and an outer layer of the flexible sheet material with the reinforcing mesh arranged therebetween.

Each side panel may comprise one or more regions where the reinforcing mesh is moveable relative to the inner and outer layers of flexible sheet material in a direction extending between the inner and outer layers of flexible sheet material.

The reinforcing mesh may be indirectly connected to the flexible sheet material. This helps to prevent the reinforcing mesh from catching on the inner and/or outer layers of sheet material.

The cover may comprise a connecting member attached to the flexible sheet material, wherein the reinforcing mesh is attached to the connecting member to indirectly connect the reinforcing mesh to the flexible sheet material.

The reinforcing mesh may be stitched or glued to the connecting member. The connecting member may be stitched or glued to the flexible sheet material.

The connecting member may comprise a woven or fabric material, optionally wherein the connecting member comprises a polymeric material, for example nylon or polypropylene.

The cover may comprise a reinforcing fabric extending over intersections between the upper panel and each side panel.

The reinforcing fabric may be arranged on an exterior of the upper panel and respective side panel.

The reinforcing fabric may comprise a woven polymeric material, for example nylon or polypropylene.

Each side panel may be connected to the upper panel, for example via stitching and/or an adhesive, or each side panel may be integrally formed with the upper panel.

The mesh may extend over substantially all of, for example an entirety of, a width of each side panel. This arrangement helps to provide reinforcement all the way around the cover, and so all the way around the enclosure, which further helps to prevent people from cutting open the side panel and accessing the goods covered by the cover.

The reinforcing mesh of each side panel may define lateral side edges. The lateral side edges of adjacent side panels may be arranged side-by-side, in use. This arrangement helps to provide reinforcement all the way around the cover, and so all the way around the enclosure, which further helps to prevent people from cutting open the side panel and accessing the goods covered by the cover.

The lateral side edges of adjacent side panels may be in contact, in use. This arrangement helps to provide reinforcement all the way around the cover, and so all the way around the enclosure, which further helps to prevent people from cutting open the side panel and accessing the goods covered by the cover.

The lateral side edges of adjacent side panels may be releasably connected together. This arrangement helps to provide reinforcement all the way around the cover, and so all the way around the enclosure, which further helps to prevent people from cutting open the side panel and accessing the goods covered by the cover.

The lateral side edges of the reinforcing mesh may comprise a mesh of increased thickness. Providing a thicker mesh wire in the side regions of the mesh helps to further reinforce the corner regions of the cover, which further helps to prevent people from cutting open the side panel and accessing the goods covered by the cover.

Each side panel may define a height extending from the edge of the upper panel to a distal edge of said side panel. The reinforcing mesh may extend at least partially along said height. This helps to provide an area or region that is reinforced so as to prevent people from cutting open the side panel and accessing the goods covered by the cover. Extending the mesh only over a part of the height of the side panels helps to reduce the weight of the cover.

The reinforcing mesh may extend from or adjacent to the distal, or lower, edge of the side panel. A person attempting to walk between pallets with goods on them may be obscured from view by hiding between the pallets to attempt to cut open the cover. Arranging the mesh to extend from the bottom of the side panels provides reinforcement for the cover in a lower region of the side panels, where a person may be obscured view to attempt to cut through the cover.

The reinforcing mesh may extend to a distance in the range 30 cm to 120 cm away from the distal edge of the side panel. The reinforcing mesh may extend to a distance in the range 40 cm to 110 cm away from the distal edge of the side panel. A person attempting to walk between pallets with goods on them may be obscured from view by hiding between the pallets to attempt to cut open the cover. Arranging the mesh to extend from the bottom of the side panels provides reinforcement for the cover in a lower region of the side panels, where a person may be obscured view to attempt to cut through the cover. Extending the mesh only over a part of the height of the side panels helps to reduce the weight of the cover.

The reinforcing mesh may extend to a distance in the range 40 cm to 60 cm away from the distal edge of the side panel. The reinforcing mesh may extend to a distance approximately 50 cm away from the distal edge of the side panel. A person attempting to walk between pallets with goods on them may be obscured from view by hiding between the pallets to attempt to cut open the cover. Arranging the mesh to extend from the bottom of the side panels provides reinforcement for the cover in a lower region of the side panels, where a person may be obscured view to attempt to cut through the cover. Extending the mesh only over a part of the height of the side panels helps to reduce the weight of the cover.

The reinforcing mesh may extend to a distance in the range 90 cm to 110 cm away from the distal edge of the side panel. The reinforcing mesh may extend to a distance approximately 100 cm away from the distal edge of the side panel. A person attempting to walk between pallets with goods on them may be obscured from view by hiding between the pallets to attempt to cut open the cover. Arranging the mesh to extend from the bottom of the side panels provides reinforcement for the cover in a lower region of the side panels, where a person may be obscured view to attempt to cut through the cover. Extending the mesh only over a part of the height of the side panels helps to reduce the weight of the cover.

The reinforcing mesh may extend over at least a quarter of the height of each side panel. The reinforcing mesh may extend over a majority of the height of each side panel. The reinforcing mesh may extend over substantially all of, for example an entirety of, the height of each side panel.

The reinforcing mesh may define an array of apertures. A maximum spacing between opposing sides of each aperture may be less than 4 cm. Providing apertures in the mesh of this size have been found to prevent a person's hand from passing through the mesh to access the goods, whilst helping to reduce the weight of the cover.

The reinforcing mesh may be formed from a flexible material.

The reinforcing mesh may be formed from a metallic or polymeric material.

Each side panel may comprise at least one mounting aperture at a distal region of each side panel for receiving a fastener therethrough. The reinforcing mesh may extend over said distal region of each side panel.

A base cover may be releasably connected to each side panel. Advantageously this improves the protection of the goods against environmental factors and interference.

The base cover may comprise a base panel and a plurality of base side panels. Each base side panel may be configured to releasably connect to a respective side panel. Advantageously, the cover is configured to completely enclose the pallet and goods.

Each base side panel may comprise at least one fastener configured to releasably connect said base side panel to a respective side panel via the at least one mounting aperture.

The base cover may comprise an alignment arrangement for aligning a pallet on the base cover, optionally wherein the alignment arrangement comprises one or more alignment windows.

The base cover may comprise an adjustable retention strap connected to opposing parts of the base cover and configured to extend over a pallet seated on the base cover, in use.

The sheet material may be a fabric material.

The sheet material may be a breathable material. The sheet material may be a water resistant material. The sheet material may be a thermally insulating material.

BRIEF DESCRIPTION OF THE DRAWINGS

Embodiments will now be described with reference to the accompanying drawings, in which.

DETAILED DESCRIPTION OF EMBODIMENT(S)

Figure 1:
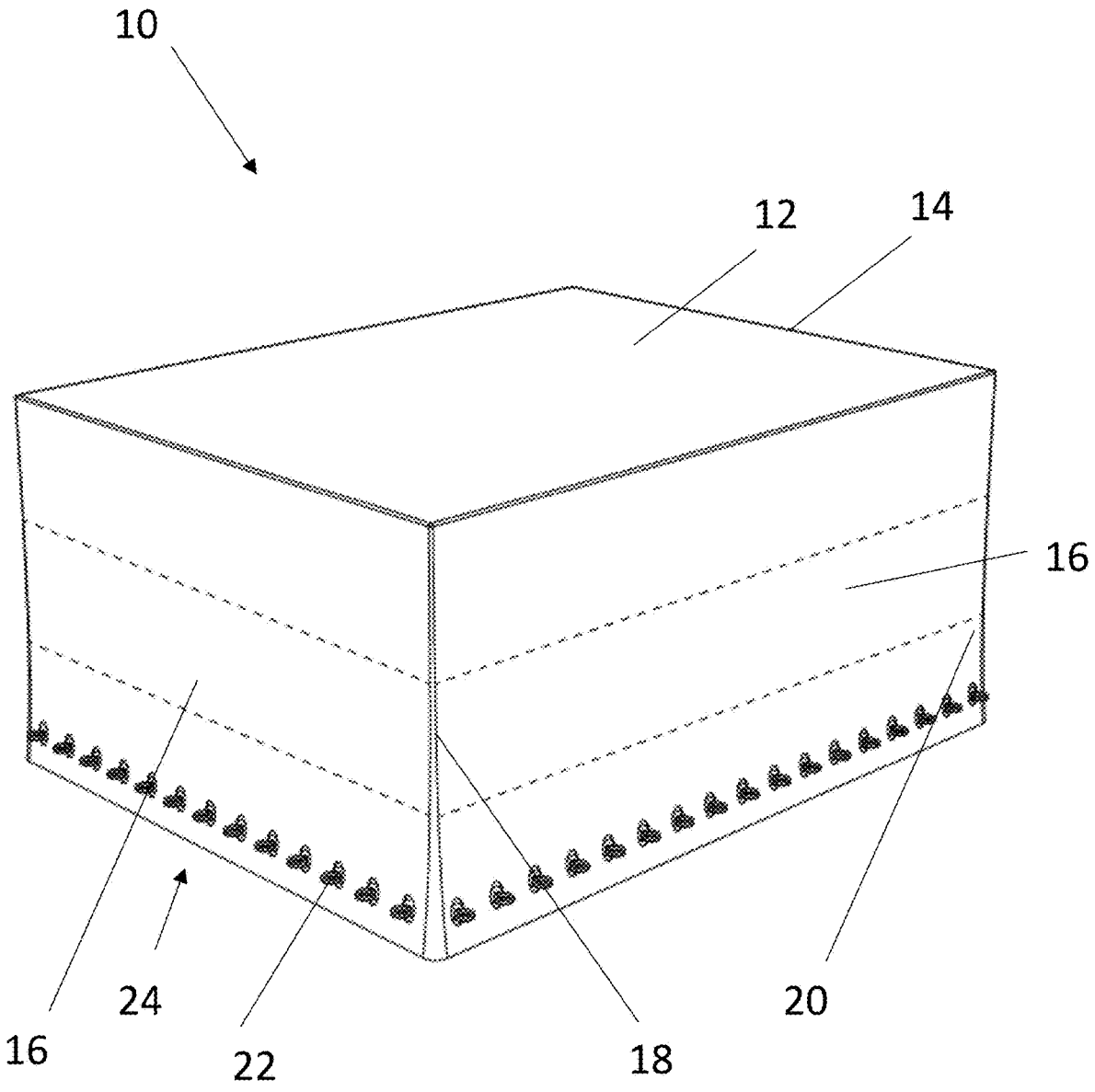
FIG. 1 shows an isometric view of a cover for covering goods according to an embodiment.

Referring firstly to FIG. 1, a cover for covering goods supported on a base platform such as a pallet is illustrated and is indicated generally at 10. It will be understood that the pallet cover 10 may be used in combination with any suitable pallet so as to cover goods stored thereon. In some embodiments, the pallet may be a PMC pallet commonly used in aviation. In other embodiments, the pallet may be a Euro pallet. It will be understood that the pallets may be any suitable size, for example, 20 cm×30 cm, 40 cm×60 cm, 80 cm×120 cm, 301 cm×158 cm, or any other suitable size or shape. The pallet cover 10 will be dimensioned to substantially match the pallet being covered.

The cover 10 includes an upper panel 12. In the illustrated embodiment, the upper panel 12 is substantially square, but in alternative embodiments the upper panel may be circular, oval, rectangular, triangular or any other suitable shape. The upper panel 12 may be sized or dimensioned to substantially match the shape, size or footprint of the pallet that is being covered.

The upper panel 12 defines four edges 14. The cover 10 includes a side panel 16 extending from each edge 14 of the upper panel 12. The side panels 16 may be integrally formed with the upper panel 12. Alternatively, the side panels 16 may be separate from and connected to upper panel 12, for example via stitching, adhesive or any other suitable arrangement.

The upper panel 12 and the side panels 16 are arranged so as to define an enclosure surrounded by said plurality of side panels 16. Put another way, the lateral edges of adjacent side panels 16 are arranged so as to be adjacent, in contact, or overlap such that the side panels 16 extend around substantially all of, or an entirety of, the enclosure. Although not illustrated, it will be understood that a pallet loaded with goods is able to be fully or almost fully enclosed by the cover 10, in use, to protect said goods, for example from the weather and from being stolen.

Each side panel 16 may be formed from a sheet material. Each side panel 16 may be flexible, for example formed from a flexible sheet material. The sheet material may be a fabric material. The fabric material may be formed from a canvas material. Alternatively, the sheet material may be formed from a polymeric material, for example a polymeric fabric material. The polymeric material may be PTFE, ePTFE, polyester, or any other suitable material. In some embodiments, the side panels 16 may be formed from a single layer of sheet material, or alternatively may be formed from multiple layers of sheet materials. In embodiments containing multiple layers, the different layers may be formed from different or the same materials. It will be appreciated that the number of layers and/or the thickness of the sheet material(s) could be varied to suit the application.

In some embodiments, the side panel 16 may be water resistant to protect the goods within from environmental factors. Put another way, in some embodiments, the side panel 16 may include at least one layer that is water resistant. In some embodiments, the side panels 16 may be breathable to prevent moisture collecting under the cover. Put another way, in some embodiments, the side panels 16 may include at least one layer that is breathable. In some embodiments, the side panel 16 may be thermally insulating for providing thermal protection to protect the goods from extremes of temperature. Put another way, in some embodiments, the side panels 16 may include at least one layer that is thermally insulating. In some embodiments, each side panel may include one or more of a metalized polymer, a foil substrate, and/or insulating fibres to provide improved thermal protection. The side panel may include an insulating foam material, wool or any other suitable insulating material. The or each layer of sheet material may be configured to be water resistant, breathable and/or thermally insulating, rather than each being provided by a separate sheet material.

The upper panel 12 may be flexible, for example formed from a flexible sheet material. It will be understood that the upper panel 12 may be formed from the materials as described for the side panels 16. The weight of the upper panel 12 and/or side panels 16 may be varied to suit the application. In embodiments where the upper panel 12 and the side panels 16 are formed from a canvas or fabric material, said upper panel 12 and side panels 16 may be integrally woven together.

Each side panel 16 defines first and second opposing lateral side edges 18, 20. The lateral side edges 18, 20 of adjacent panels 16 may be arranged side-by-side, in use. In an embodiment, the lateral side edges 18, 20 of adjacent side panels 16 are in contact, in use. Additionally or alternatively, the lateral side edges 18, 20 of adjacent side panels 16 may be releasably connected together, in use.

Figure 2:
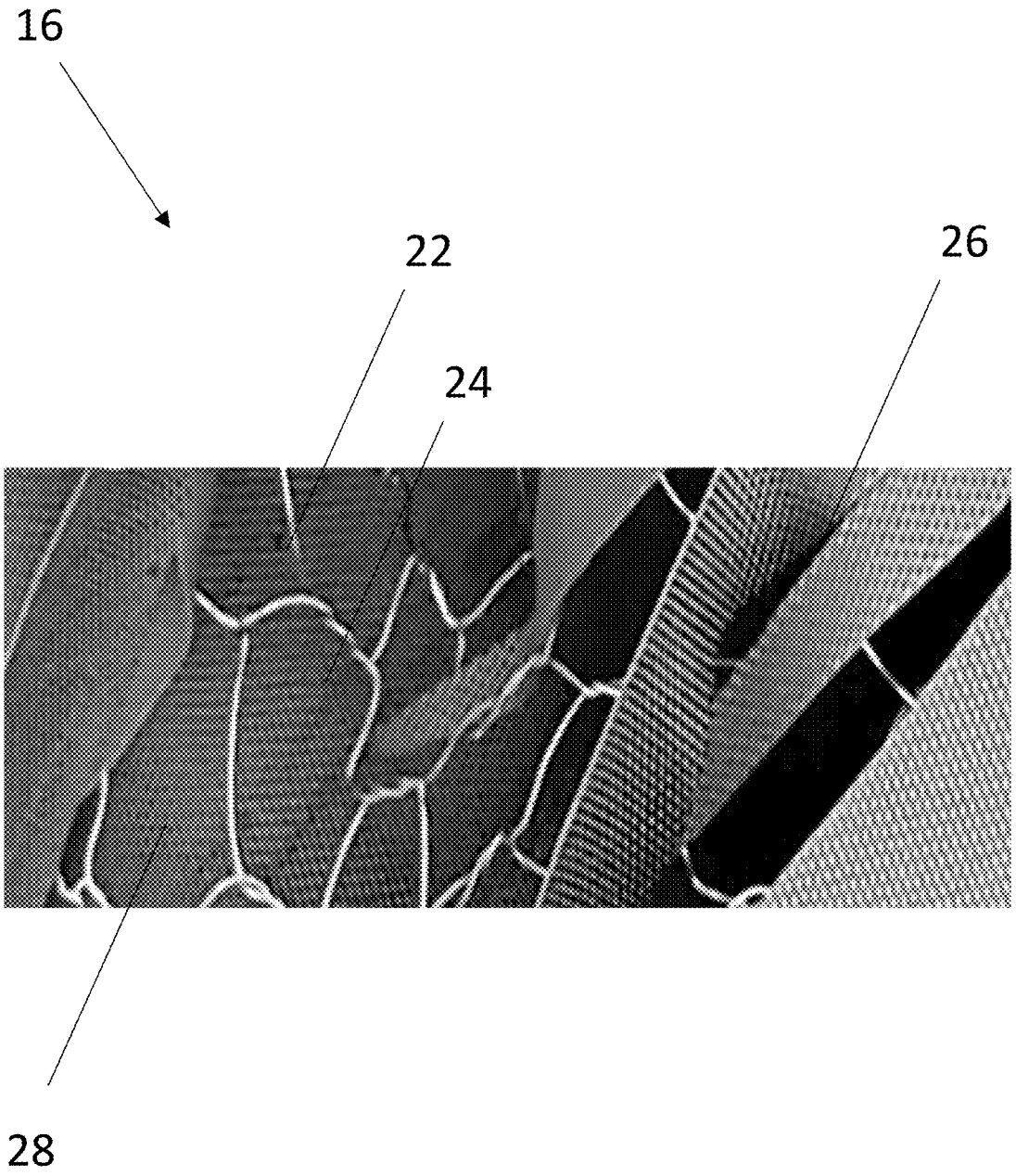
FIG. 2 shows a side panel of the cover of FIG. 1.

Referring to FIG. 2, each side panel 16 includes a reinforcing mesh 22 extending at least partially over the sheet material. The reinforcing mesh 22 is configured to reinforce the respective side panel 16 to prevent the side panel from being cut open, for example to access good stored under the cover 10. The reinforcing mesh 22 may formed from a flexible material. In some embodiments, the reinforcing mesh 22 may be formed from a metallic material. The metallic material may be aluminium, steel, stainless steel, titanium or any other suitable metal. In other embodiments, the mesh may be formed from a polymeric or composite material. In some embodiments, the upper panel 12 may be provided with a reinforcing mesh, similar to the reinforcing mesh 22, extending at least partially, for example entirely, thereover. The reinforcing mesh may extend over substantially all of, for example an entirety of, the upper panel 12.

The reinforcing mesh 22 defines an array of apertures 24. In the present embodiment, the apertures are substantially hexagonal, but alternatively they may be square, rectangular or any other suitable shape. The apertures 24 each define a spacing between opposite sides thereof. A maximum spacing between opposing sides of each aperture 24 may be configured to prevent or restrict a hand passing through the mesh 22 and so the side panel 16. In some embodiments, the maximum spacing between opposing sides of each aperture 24 may be approximately or less than 5 cm, for example approximately or less than 4 cm. Providing apertures of these sizes has been found to provide sufficient protection to the goods covered by the cover 10, for example by preventing a person's hands from passing through, whilst minimising the weight of the cover 10. In some embodiments, the maximum spacing between opposing sides of each aperture 24 may be approximately or less than 3 cm, 2.5 cm, 2 cm, or 1 cm. It would be appreciated that the size of each aperture could be larger or smaller than the stated examples.

The reinforcing mesh 22 may be attached to the sheet material of each side panel 16. In an embodiment, the reinforcing mesh 22 may be glued to the sheet material of the side panels 16. Alternatively, or additionally, the reinforcing mesh 22 may be stitched to the sheet material of the side panels 16.

In some embodiments, each side panel 16 may be formed from a single outer layer 26 of sheet material with the reinforcing mesh 22 underneath. In the illustrated embodiment, each side panel 16 is formed from an inner layer of sheet material 28 and an outer layer 26 of sheet material. In such embodiments, the reinforcing mesh 22 is arranged between the inner layer 28 and the outer layer 26. It will be appreciated that the inner and outer layers 20, 22 may be formed from the same or different materials. In embodiments including the inner and outer layers 28, 26, the reinforcing mesh 22 may be attached to one or both of the inner layer 28 and outer layer 26.

Figure 3:
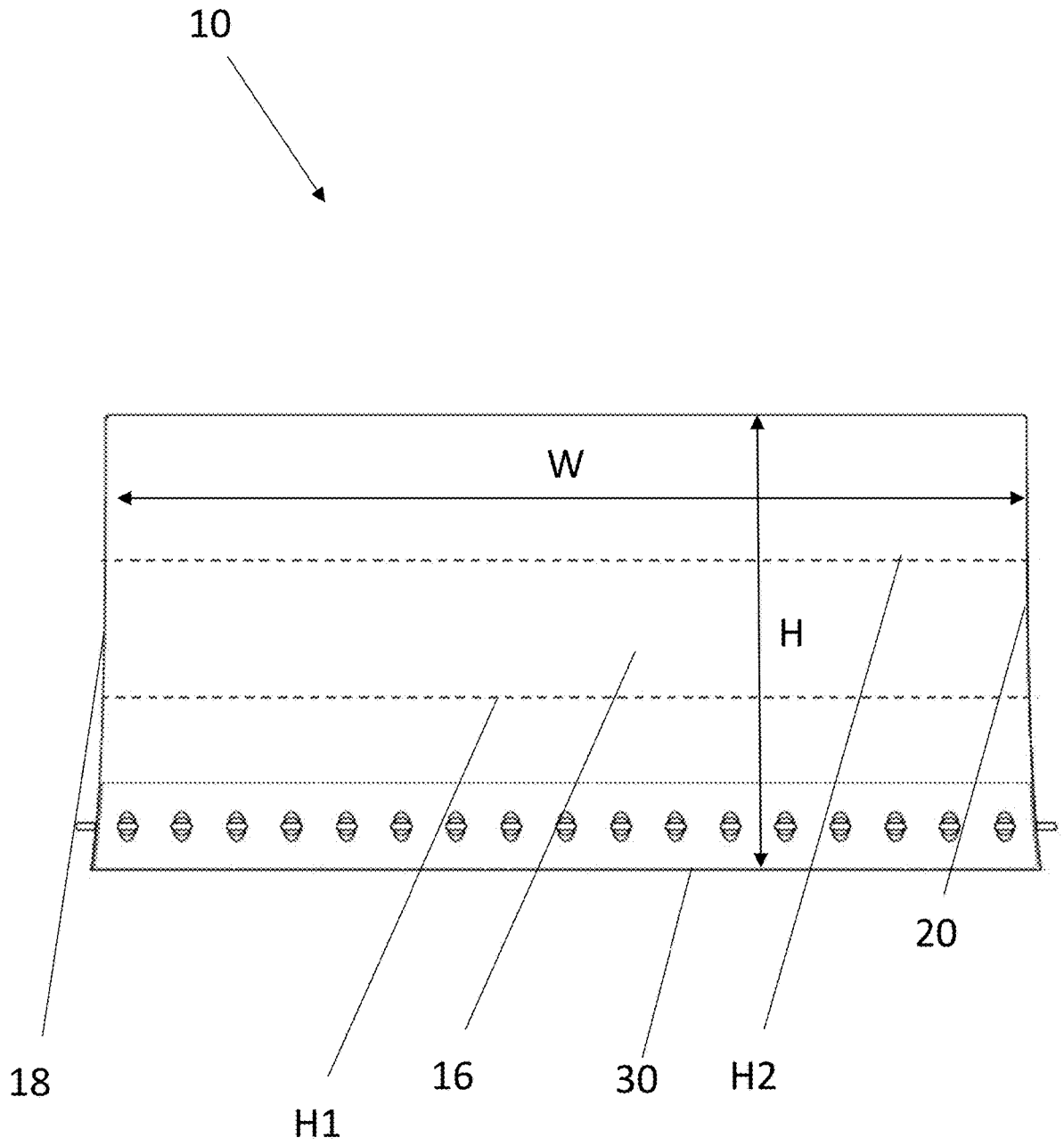
FIG. 3 shows a side panel of the cover of FIG. 1.

Referring now to FIG. 3, each side panel 16 defines a width W extending between the opposing lateral edges 26, 28 thereof. Each side panel defines a height H extending from the edge 14 of the upper panel 12 (i.e. the intersection between the upper panel 12 and the side panel 16) to a distal edge 30 of said side panel 14.

The reinforcing mesh 22 extends over each side panel 16. Put another way, the reinforcing mesh 22 extends over a width $W_1$ of each side panel 16 and a height $H_1$ of each side panel 26.

In some embodiments, the reinforcing mesh 22 may extending over a majority of the width W of each side panel 16. The reinforcing mesh 22 may extend over substantially all of the width of each side panel 16, for example the reinforcing mesh 16 may extend over an entirety of the width of each side panel 16. Put another way, the reinforcing mesh 22 of each of the side panels 16 may be collectively arranged so as to extend around substantially all of, for example an entirety of, the goods within the enclosure defined by the cover 10. This helps to provide protection surrounding the goods, which has been found to further restrict access to the goods within the enclosure.

In some embodiments, the reinforcing mesh 22 of adjacent side panels 22 may be connected together, for example by one or more fasteners, clips or cables. Additionally or alternatively, the reinforcing mesh 16 may include a region of increased rigidity, strength and/or thickness at the lateral side edges of the reinforcing mesh 22. In some embodiments, the reinforcing mesh 22 may be arranged so that the lateral side edges of the reinforcing mesh includes multiple layers of the reinforcing mesh 22. Providing any of these arrangements have been found to increase the protection provided by the mesh to the cover 10 at the intersection between adjacent side panels 16.

The reinforcing mesh 22 extends at least partially along the height H of each side panel 22. In some embodiments, the reinforcing mesh 22 may extend over a quarter of the height H of each side panel, for example over half of the height of each side panel 16, or over three questers of the height of each side panel 16. In some embodiments, the reinforcing mesh 22 may extend over substantially all of, for example an entirety of, the height H of each side panel 16.

In some embodiments, for example where the overall weight of the cover 10 needs to be minimise or reduced, the reinforcing mesh 22 may not extend the full height H of each side panel 16. In some embodiments, the reinforcing mesh 22 may extend over the height H of each side panel 16 by a distance in the range 30 cm to 120 cm, optionally in the range 40 cm to 110 cm. In some embodiments, the reinforcing mesh 22 may extend over the height H of each side panel 16 by a distance in the range 40 cm to 60 cm, 60 cm to 90 cm, or 90 cm to 110 cm.

In some embodiments, for example the embodiment illustrated in FIG. 3, the reinforcing mesh 22 may extend over substantially all of, or an entirety of, the width W of each side panel 16 and doesn't extend over all of the height H of said side panel. In alternative embodiments, however, the reinforcing mesh 16 may extend over substantially all of, for example an entirety of, each side panel 14.

In some embodiments the extent of the mesh along height h of side panel 14 may be configured to protect the cover in areas most at risk of slashing. During transport of good on a vehicle or aircraft, lower regions of the cover 10 may be obscured from view and so are potentially at a greater risk from being cut open to access the goods. Due to this, the reinforcing mesh 22 may only be provided in this lower region. In such embodiments, the reinforcing mesh 22 may extend from the distal edge 30 of each side panel 16 or may extend from a distal end region of each side panel 16. In alternative embodiments, the reinforcing mesh 14 could also extend from any location within the height h of the side panels 14.

In some embodiments, the reinforcing mesh 22 may extend from the distal end of the side panel 16 by a distance in the range 30 cm to 120 cm, optionally in the range 40 cm to 110 cm. In some embodiments, the reinforcing mesh 22 may extend from the distal end of the side panel 16 by a distance H1 in the range 40 cm to 60 cm or by a distance H2 in the range 90 cm to 110 cm.

Figure 4:
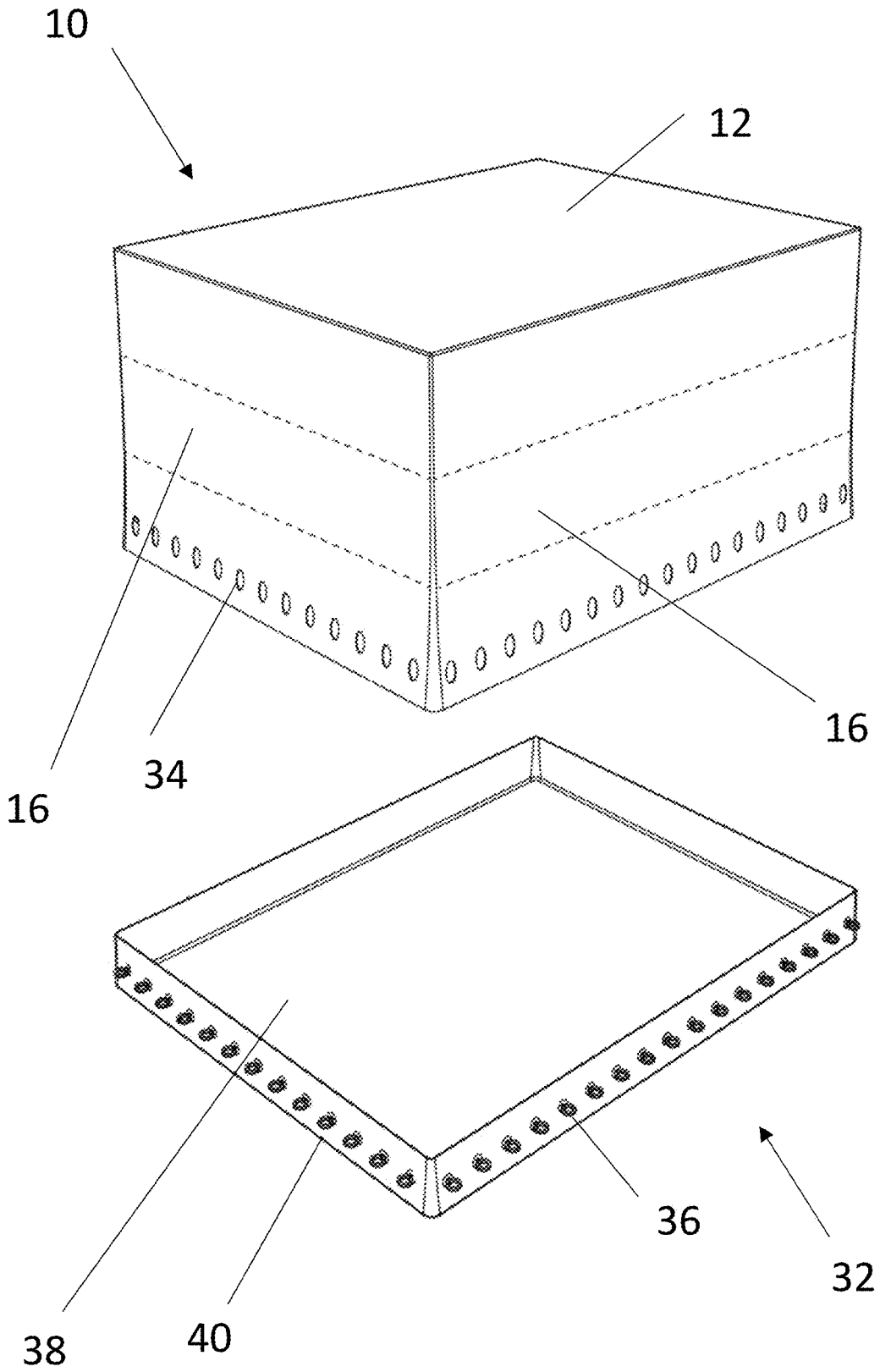
FIG. 4 shows an exploded view of the cover of FIG. 1.

Referring to FIG. 4, in some embodiments, the cover 10 is attachable, connectable and/or securable to a base cover 32. The cover 10 and base cover 32 are releasably connected together. The base cover 32 is provided with a base cover mounting arrangement 36 to releasably secure the base cover 32 to the cover 10.

The cover 10 is provided with a cover mounting arrangement 34 for mounting or securing the cover 10 to a base cover 32. In the illustrated embodiment, the cover mounting arrangement 34 is provided at a distal region of each side panel 16. In some embodiments, the reinforcing mesh 16 may extend over the distal region 24 of each side panel 14 containing the cover mounting arrangement 34.

The cover mounting arrangement 34 may be provided in the form of at least one mounting aperture 34 provided in each side panel 16. A plurality of mounting apertures 34 may be provided in each side panel 16. In the illustrated embodiment, the at least one mounting aperture 34 is located at a distal region of each side panel 16. The one or more mounting apertures 34 are configured to receive a fastener or connector therethrough. In an alternative embodiment, each mounting aperture 34 may be replaced with a fastener, connector or buckle to connect to an aperture on the base cover 32.

The base cover 32 may include a base panel 38 and a plurality of base side panels 40 each extending from an edge of the base panel 38. The base cover mounting arrangement 34 is provided on each base side panel 40. Put another way, each side panel 16 connects to a respective base side panel 40 via corresponding mounting arrangements 34, 36 on both side panel 16 and base side panel 40.

The base cover mounting arrangement 36 may be provided in the form of a plurality of fastening means 36 for releasably connecting the cover 10 and the base cover 32. In some embodiments, the base cover mounting arrangement 36 included turnbutton fasteners, but any suitable fastener may be used in alternative embodiments. In another embodiment the fastener may be a buckle and strap.

In some embodiments, a spacing between adjacent mounting apertures 34 on the side panels 16 and between adjacent fasteners 36 on the base cover side panels 40 may be approximately or less than 10 cm, for example approximately or less than 8 cm. Providing a maximum spacing between fastening means 36 of this size has been found to provide sufficient protection to the goods covered by the cover 10, whilst minimising the number of fastening means 36 required. In some embodiments, the maximum spacing between fastening means 36 may be approximately or less than 6 cm, 5 cm, 3 cm, 2.5 cm, 2 cm, or 1 cm.

The base cover 30 may be made of substantially the same material as the cover 10. The plurality of base side panels 34 may be configured to releasably connect the base side panels 34 to respective side panels 14 via the at least one mounting aperture 22.

The base cover 30 is formed from a sheet material. The sheet material may be a fabric material. The fabric material may be formed from a canvas material.

Alternatively, the sheet material may be formed from a polymeric material, for example a polymeric fabric material. The polymeric material may be PTFE, ePTFE, polyester, or any other suitable material. In some embodiments, the sheet material may be water resistant to protect the goods within from environmental factors. In some embodiments, the sheet material may be breathable to prevent moisture collecting under the cover. It will be understood that the base panel 38 may be formed from the same sheet material as the base side panels 40. In some embodiments, the base side panels 40 may have a reinforcing mesh as has been described above with reference to the reinforcing mesh 22 on the side panels 14. In such embodiments, the reinforcing mesh may extend over the region of each base side panel 40 having the base cover mounting arrangement 36. In other embodiments, the reinforcing mesh may extend over substantially all of, for example an entirety of, each base side panel 40.

Although the mounting arrangement of the cover 10 has been described as being secured to the base cover 32, it will be understood that in some embodiments the base cover 32 may be omitted. In such embodiments, the mounting arrangement of the cover 10 may secure the cover 10 directly to a pallet (not shown), for example via a pallet mounting arrangement such as fasteners or apertures provided on the pallet, similar to the base cover mounting arrangement described above. In alternative embodiments, connecting wires may pass through or under a pallet between the side panels 16 to secure the side panels to each other.

Figure 5:
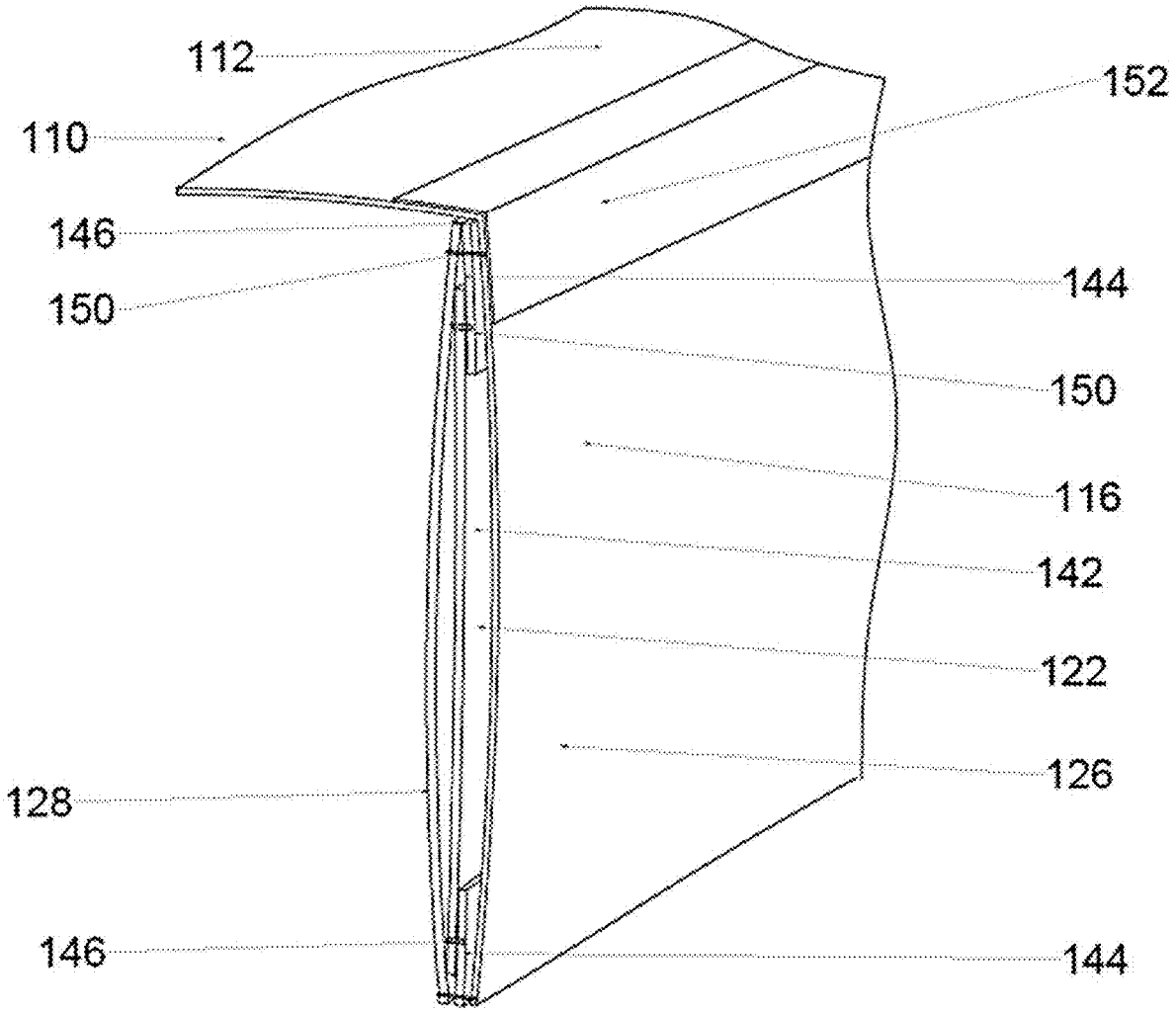
FIG. 5 shows a cross-section isometric view of a cover according to an embodiment.

FIG. 5 shows an alternative embodiment of the cover 110. Like parts with the embodiment of FIGS. 1 to 4 shall be labelled with the prefix "1". It shall be appreciated that the teachings of FIGS. 1 to 4 are applicable to the embodiment of FIG. 5, and only differences are discussed.

In the embodiment of FIG. 5, each side panel 116 include one or more regions 142 where the reinforcing mesh 122 is moveable relative to the sheet material 126, 128. Put another way, the reinforcing mesh 122 is moveable relative to the sheet material 126 at least in a direction extending substantially perpendicularly to the sheet, e.g. along an axis extending between inner and outer surfaces of the sheet 126. This provides one or more regions where the reinforcing mesh may be considered to float between the sheet material 126, 128. Movement of the reinforcing mesh 122 relative to the sheet material 126 makes the side panel more difficult to cut open, thereby helping to prevent people from cutting open the side panel 116 and accessing the goods covered by the cover 110. Put another way, movement of the reinforcing mesh 122 relative to the sheet material 126, 128 helps to provide a side panel 116 with improved cut resistance or slash resistance.

In the embodiment of FIG. 5, each side panel 116 includes one region 142 wherein the reinforcing mesh 122 is moveable relative to the sheet material 126, 128. However it shall be appreciated that in alternative embodiments, any suitable number of regions 142 may be provided on each side panel 116.

The reinforcing mesh 122 is connected to the sheet material 126, 128 at or near opposing edges 144 of the reinforcing mesh 122. The one or more regions 142 where the reinforcing mesh 122 is moveable relative to the sheet material 126, 128 are defined between said opposing edges 144. Put another way, the opposing edges 144 act as a fixed boundary, and the one or more regions 142 is defined between the fixed boundary.

In the embodiment of FIG. 5, the opposing edges are upper and lower opposing edges 144. The reinforcing mesh 122 is connected to the sheet material 126, 128 along the upper and lower opposing edges 144, and the reinforcing mesh 122 is free to move relative to the sheet material 126, 128 alongside edges of the reinforcing mesh 122. As such, the region 142 is partially enclosed by the upper and lower opposing edges 144. It shall be appreciated that in alternative embodiments, the one or more regions 142 may be entirely enclosed by the opposing edges 144. The opposing edges 144 may be side edges of the reinforcing mesh 122. The opposing edges may be both upper and lower edges and side edges of the reinforcing mesh 122 in some embodiments. In some embodiments, the reinforcing mesh 122 may only be attached to the sheet material 126, 128 at or near to an outer perimeter of the reinforcing mesh 122, for example entirely around the perimeter of the reinforcing mesh.

The side panels 116 include an inner and an outer layer 128, 126 of sheet material with the reinforcing mesh 122 arranged therebetween. It shall be appreciated that the inner and outer layers 128, 126 may be of substantially the same configuration to the inner and outer layers 28, 26 of FIGS. 1 to 4.

In the one or more regions 142, the reinforcing mesh 122 is moveable relative to the inner and outer layers 128, 126 of sheet material. Put another way, the reinforcing mesh 122 is moveable relative to the inner and outer layers in a direction extending between the inner and outer layers 128, 126 of sheet material. In one embodiment, the reinforcing mesh 122 may be connected to the sheet material 126, 128 at or near an upper edge of the reinforcing mesh so as to be suspended between the sheet materials 126, 128. In some embodiments, the reinforcing mesh 122 may be connected to the sheet material 126, 128 at or near opposing edges 146 of the sheet material 126, 128 or the reinforcing mesh 122, as illustrated in FIG. 5. It shall be appreciated that the reinforcing mesh 122 may be connected to the sheet material 126, 128 at a perimeter region of the sheet material 126, 128, i.e. a region of the sheet material 126, 128 that is closer to a perimeter thereof than to a centre thereof.

The one or more regions 142 where the reinforcing mesh 122 is moveable relative to the sheet material 126, 128 are defined between said opposing edges 146. The reinforcing mesh 122 may be connected to the sheet material 126, 128 (for example to the inner and/or outer layer 128, 126 of sheet material) at or near to upper and lower edges 146 of the sheet material 126, 128, first and second side edges of the sheet material; or upper 146, lower 146, first side edge and second side edge of the sheet material 126, 128, by way of example. In the embodiment shown in FIG. 5, the reinforcing mesh 122 is connected to the sheet material 126, 128 at or near the upper and lower edges 146 of the sheet material 126, 128. In particular, the reinforcing mesh 122 is connected to both the inner and outer layers 128, 126 of sheet material at or towards respective upper and lower edges thereof.

In the embodiment shown in FIG. 5, the reinforcing mesh 122 is indirectly connected to the sheet material 126, 128. This helps to prevent the reinforcing mesh 122 from catching on the inner and/or outer layers 128, 126 of sheet material. In particular, the cover 110 includes a connecting member 150. The reinforcing mesh 122 is attached to the connecting member 150, and the connecting member 150 is attached to the sheet material 126, 128. In embodiments where the inner and outer layers 128, 126 are provided, the connecting member 150 is connected to both the inner and outer layers 128, 126. As such, the reinforcing mesh 122 is indirectly connected to the sheet material 126, 128 via the connecting member 150.

The connecting member 150 may be a connecting sheet. The connecting member 150 may include a woven or fabric material. The connecting member 150 may include a polymeric material, for example nylon or polypropylene. It shall be appreciated that the connecting member 150 may be formed from any suitable material.

A first portion of the connecting member 150 is provided between the inner and outer layer 126, 128. The inner and outer layers 126, 128 and the first portion of the connect member 150 are connected together, for example via stitching or an adhesive. A second portion of the connecting member 150 is arranged between reinforcing mesh 122 and the inner layer 128 or alternatively may be provided between the reinforcing mesh 122 and the outer layer 126. The connecting member 150 is secured to the outer layer 126, the inner layer 128 and to the reinforcing mesh 122 to connect the reinforcing mesh 122 to both the inner and outer layers 128, 126 of sheet material. Thus, the reinforcing mesh 122 is indirectly attached to the inner and outer layers of sheet material 126, 128.

The connecting member 150 is an elongate connecting member 150. In the embodiment shown in FIG. 5, the connecting member 150 is a connecting strip 150. The connecting member 150 extends along the edges 144 of the reinforcing mesh 122 that is connected to the sheet material 126, 128 so as to connect the reinforcing mesh 122 to the sheet material 126, 128. As such, connecting members 150 maybe provided along one edge, two opposing edge, or all four edges, for example. In the embodiment shown in FIG. 5, discrete upper and lower connecting members 150 are provided with a space defined therebetween in the height direction H. Put another way, two spaced apart connecting members 150 are provided extend parallel to the width W of the side panel 116. The upper and lower connecting members 150 extend substantially parallel to one another and to the upper and lower edges 144 of the reinforcing mesh 122.

It shall be appreciated that in some embodiments, more than two connecting members 150 may be provided. For example, two pairs of opposing connecting members 150 may be provided. In embodiments where the connecting members 150 are provided along the upper and lower edges and the side edges of sheet material 126, 128, the connecting members 150 may be discrete connecting members 150, or the connecting members may be at least partially continuous.

It shall be appreciated that in alternative embodiments, the connecting member 150 may be omitted, or any suitable arrangement of connecting member 150 may be provided. In some embodiments, the reinforcing mesh 122 may be directly connected to the sheet material 126, 128, for example to the inner layer 128 and/or to the outer layer 126.

The cover 110 includes a reinforcing fabric 152 extending over intersections between the upper panel 112 and a respective side panel 116. In other embodiments, the reinforcing fabric 152 may be arranged to extend over any intersection between adjacent panels of the cover 110. In particular, the reinforcing fabric 152 is arranged on an exterior of the upper panel 112 and the respective side panel 116, as illustrated in FIG. 5. The reinforcing fabric 152 may be provided as a reinforcing strip 152. The reinforcing fabric 152 includes a woven polymeric material, for example nylon or polypropylene. In alternative embodiments, any fabric, polymeric or any other suitable material may be used.

Each side panel 112 is connected to the upper panel 116, for example via stitching and/or an adhesive. In alternative embodiments, each side panel 116 is integrally formed with the upper panel 112.

Figure 6:
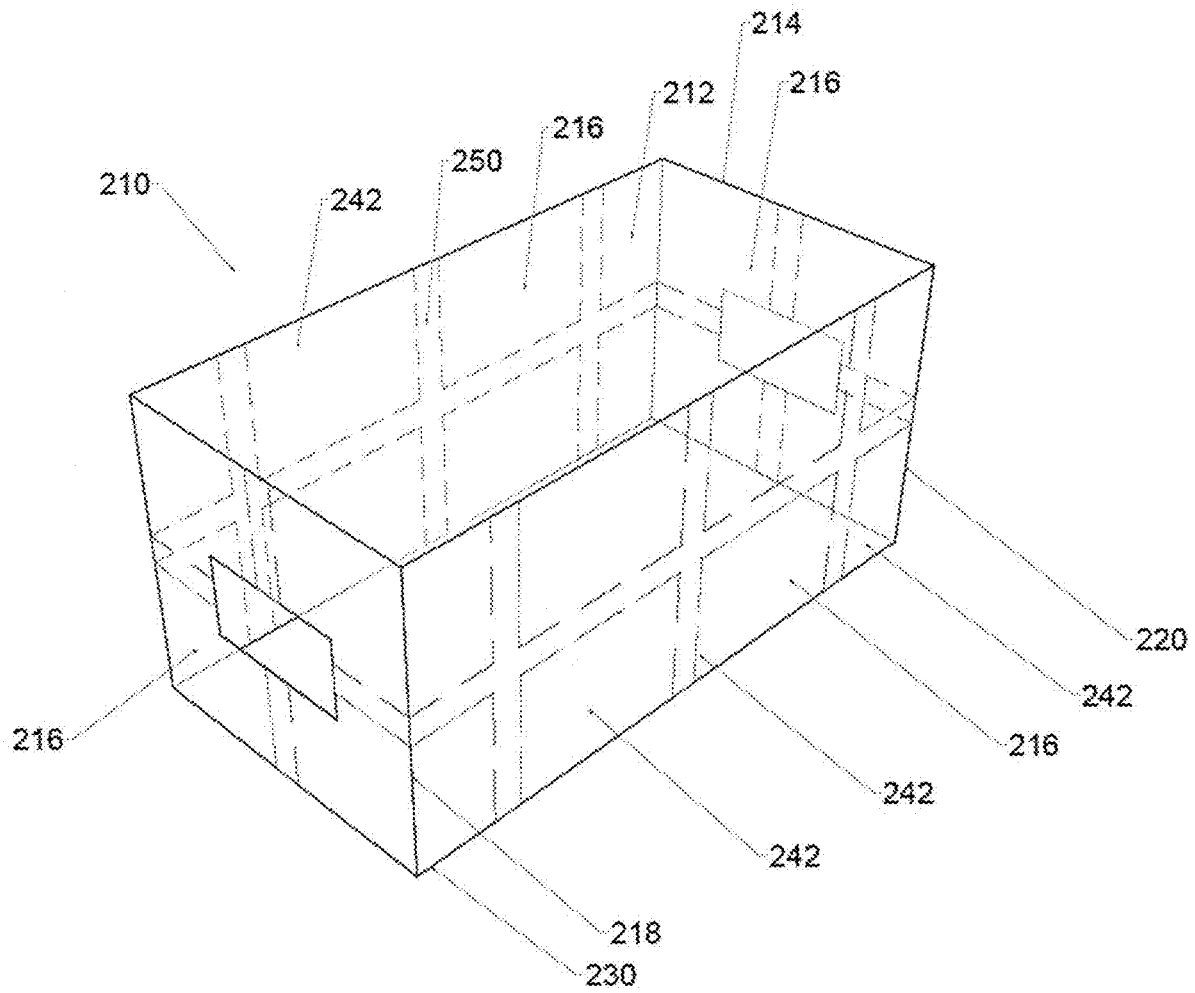
FIG. 6 shows an isometric view of a cover according to an embodiment.
Figure 7:
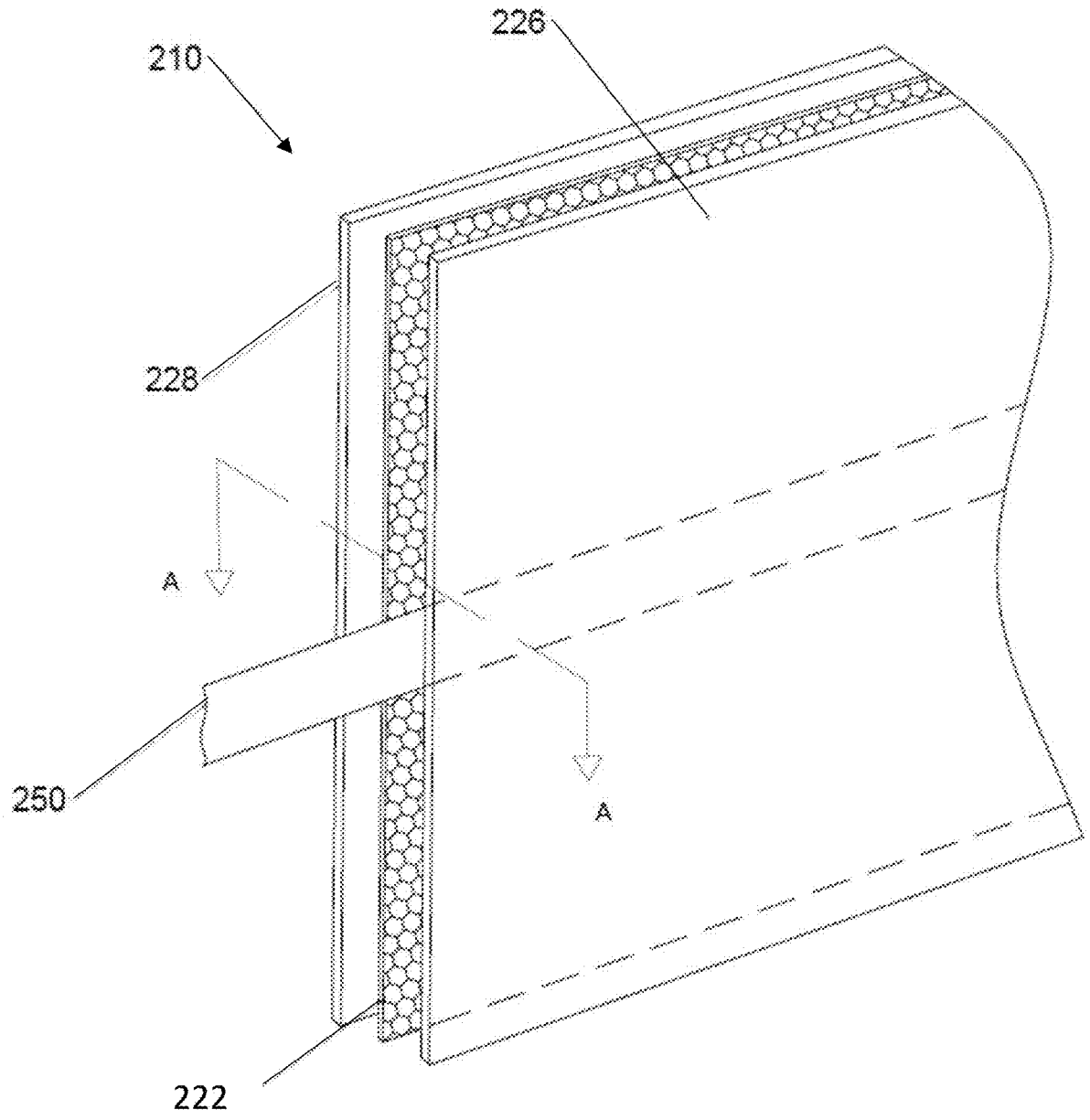
FIG. 7 shows an isometric view of a part of the cover of FIG. 6.

FIGS. 6 to 8 shows a further alternative embodiment in which each side panel 216 includes one or more regions where the reinforcing mesh 222 is moveable relative to the sheet material. Like parts with the embodiment of FIGS. 1 to 5 shall be labelled with the prefix "2". It shall be appreciated that the teachings of FIGS. 1 to 5 are applicable to the embodiment of FIGS. 6 to 8.

In the embodiment of FIG. 6, the reinforcing mesh 222 is connected to the sheet material 226, 228 in a pattern which defines a plurality of separate regions 242 where the reinforcing mesh 222 is moveable relative to the sheet material 226, 228. For reasons of clarity, only some of the regions 242 are labelled in FIG. 6 in order to illustrate where the regions 242 are provided.

The connecting members 250 are arranged in a grid arrangement, and the regions 242 are provided between the bounders of the grid arrangement. As such, connecting members 250 are provided which extend both parallel to the height H and parallel to the width W. The connecting members 250 intersect to form the grid arrangement. The connecting members 250 may be provided as a unitary grid arrangement, or a plurality of discrete connecting members 250 may be secured together to form the grid arrangement. The connecting members 250 which extend parallel to the height H extend along an entirety of the height H of the side panel 216. The connecting members 250 which extend parallel to the width W extend along an entirety of the width W of the side panel 216.

The connecting members 250 are arranged such that the regions 242 extend over a greater proportion of the side panel 216 than the connecting members 250. Put another way, the regions 242 extend over a majority of the side panel 216.

In the embodiment shown in FIG. 6, three connecting members 250 are provided on two opposing side panels 216 which extend parallel to the height H, and one connecting member 250 is provided on the same two opposing side panels 216 which extends parallel to the width W. As such, 8 regions 242 are provided on each of the opposing side panels 116. On the other two opposing side panels 216, one connecting member 250 is provided which extends parallel to the height H, and one connecting member 250 is provided which extends parallel to the width W. As such, four regions 242 are provided on each of the other two opposing side panels 216.

It shall be appreciated that in alternative embodiments, any suitable number of connecting members 250 may be provided extending parallel to the height H and/or width W, for example depending on a size of the side panel 216. Furthermore, the connecting members 250 may provided at a non-zero angle with respect to the height H and/or width W. In some embodiments, connecting members 250 may be provided which extend parallel to only the height H or only the width W of the side panel 216.

Figure 8A:
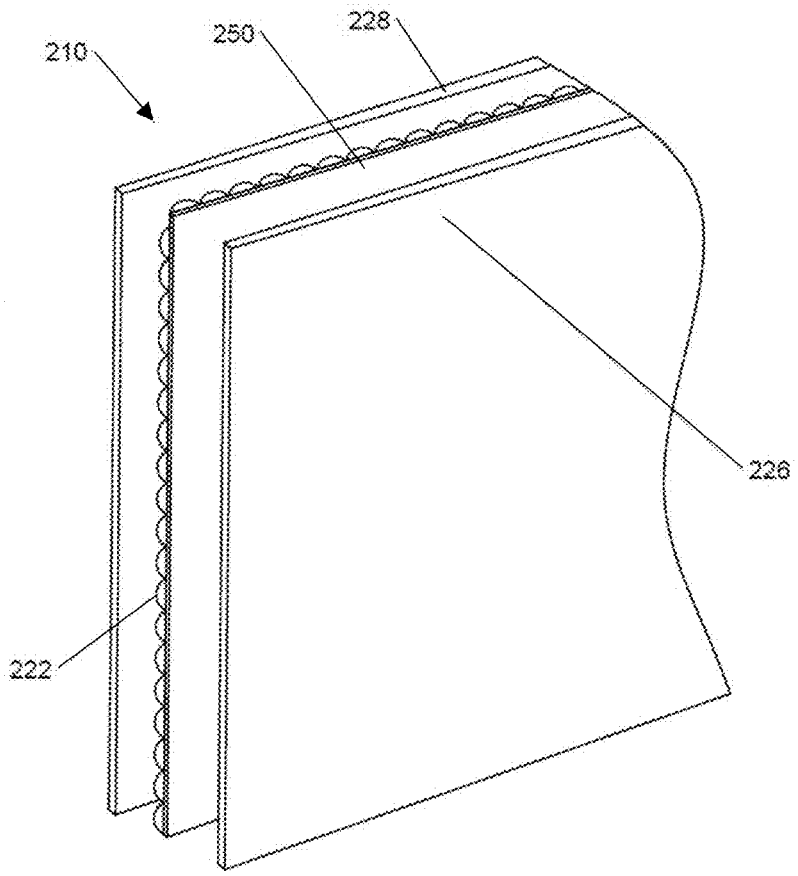
FIGS. 8A and 8B show isometric and cross-sectional views of the cover of FIG. 7 along the line A-A.
Figure 8B:
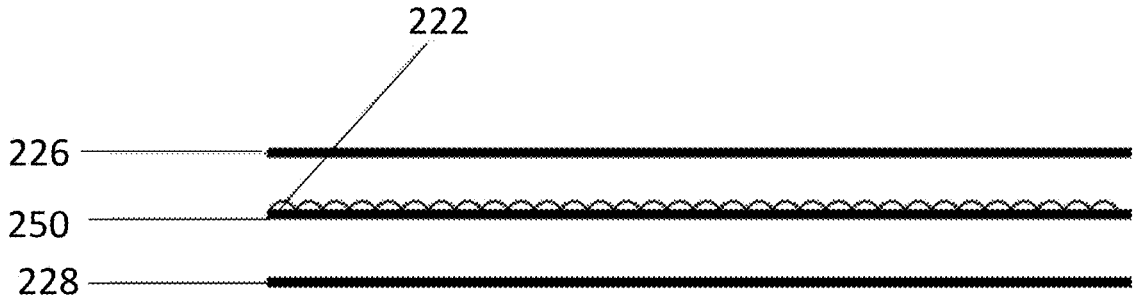
Figure 9:
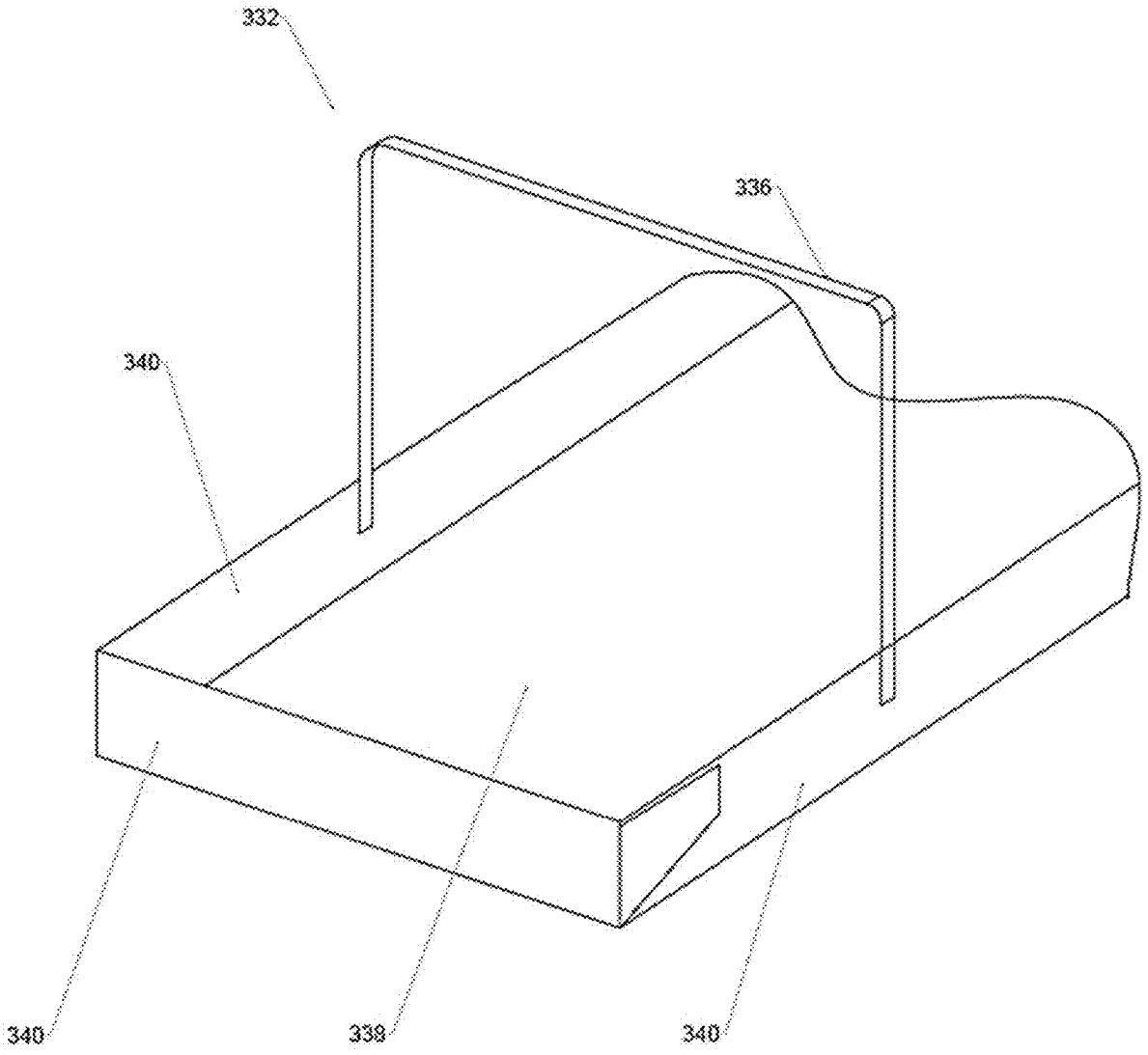
FIG. 9 shows an isometric view of a base cover according to an embodiment.

As illustrated in FIGS. 7, 8A and 8B, the connecting members 250 are located between the outer layer 226 and the reinforcing mesh 222. As such, the layers are arranged in the following order: inner layer 228, reinforcing mesh 222, connecting member 250, outer layer 226. It shall be appreciated that in alternative embodiments, the connecting member 250 may be located between the inner layer 128 and the reinforcing mesh 222, FIG. 9 shows an alternative embodiment of the base cover 332. Like parts with the embodiment of FIGS. 1 to 8 shall be labelled with the prefix "3". It shall be appreciated that the teachings of FIGS. 1 to 8 are applicable to the embodiment of FIG. 9.

In the embodiment of FIG. 9, an alternative base cover mounting arrangement 336 is provided to releasably secure the base cover 332 to the cover 10. The base cover mounting arrangement 336 includes a strap 336 which extends between opposing sides 340 of the base cover 332. The strap 336 may be an adjustable strap 336. As such, the strap 336 is able to accommodate covers 10 of varying sizes, and to releasably secure the cover 10 thereto. When the base cover 332 is secured to the cover 10, the strap 336 extends over the cover 10 to releasably secure the cover 10 to the base cover 332. It shall be appreciated that in some embodiments, a plurality of straps 336 may be provided to secure the cover 10 to the base cover 332.

Figure 10:
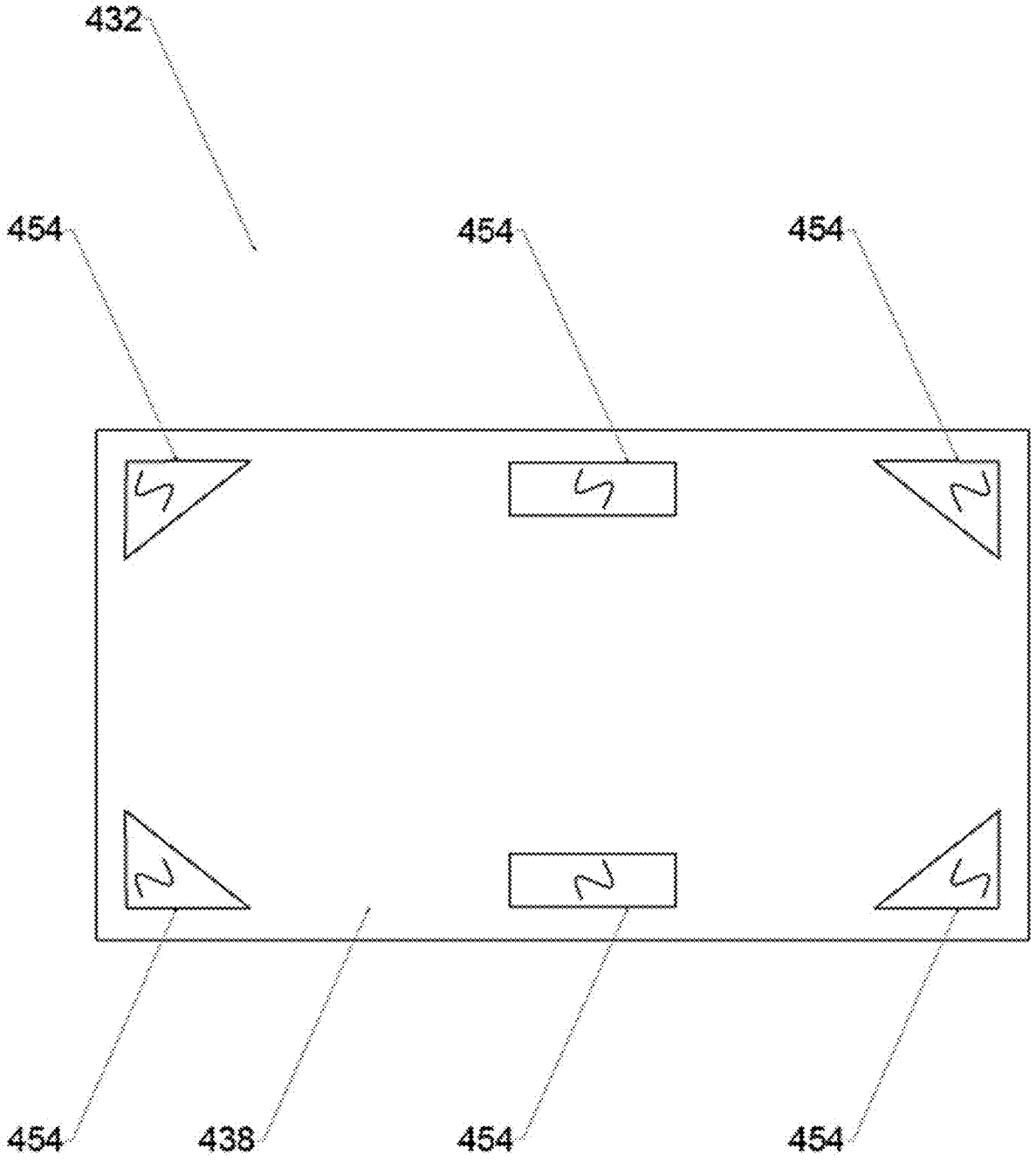
FIG. 10 shows an isometric view of a base cover according to an embodiment.

FIG. 10 shows a further alternative embodiment of the base cover 432. Like parts with the embodiment of FIGS. 1 to 9 shall be labelled with the prefix "4". It shall be appreciated that the teachings of FIGS. 1 to 9 are applicable to the embodiment of FIG. 10.

In the embodiment of FIG. 10, the base cover 432 includes a plurality of windows 454 for providing visibility to an interior of the base cover 432 from a location exterior of the base cover 432. The windows 454 assist correct alignment of the base cover 432 onto the pallet (not shown). The windows 454 may include a transparent or translucent material, for example a sheet of translucent or transparent polymer material.

The windows 454 are provided on the base panel 438 of the base cover 432. In particular, the windows 454 are provided at or towards a perimeter edge of the base panel 438. In the embodiment shown in FIG. 10, windows 454 are provided at each corner of the base panel 438, and windows 454 are provided between the windows 454 at the corner along two opposing edges of the base panel 438. As such, six windows 454 are provided. The windows 454 located at the corners are substantially triangular, for example right-angled triangles, and the windows 454 located between the corners are substantially rectangular.

It shall be appreciated that in alternative embodiments, any suitable number of windows 454 may be provided. The windows 454 may be located at any suitable location on the base cover 332, and the windows 454 may be any suitable shape.

It will be understood that any of the features discussed with reference to the embodiments illustrated in FIGS. 1 to 10 may be combined with any of the other illustrated embodiments.

Although the teachings have been described above with reference to one or more preferred embodiments, it will be appreciated that various changes or modifications may be made without departing from the scope as defined in the appended claims.

The invention claimed is:

1. A cover for covering goods supported on a base platform, the cover comprising:

an upper panel; and a plurality of side panels each extending from an edge of the upper panel to define an enclosure surrounded by said plurality of side panels, wherein each side panel is formed from a flexible sheet material, wherein each side panel comprises a reinforcing mesh extending at least partially over an area defined by the sheet material, and wherein each side panel comprises one or more regions where the reinforcing mesh is not attached to the sheet material such that the reinforcing mesh is moveable relative to the sheet material in a direction substantially perpendicular to the sheet material.

2. The cover according to claim 1, wherein the reinforcing mesh is connected to the flexible sheet material at or near to opposing edges of the flexible sheet material and a region where the reinforcing mesh is moveable relative to the flexible sheet material is defined therebetween.

3. The cover according to claim 1, wherein the reinforcing mesh is connected to the flexible sheet material in a pattern which defines a plurality of separate regions in which the reinforcing mesh is moveable relative to the flexible sheet material.

4. The cover according to claim 1, wherein the side panels comprise an inner and an outer layer of the flexible sheet material with the reinforcing mesh arranged therebetween.

5. The cover according to claim 4, wherein each side panel comprises one or more regions where the reinforcing mesh is moveable relative to the inner and outer layers of flexible sheet material in a direction extending between the inner and outer layers of flexible sheet material.

6. The cover according to claim 1, wherein the reinforcing mesh is indirectly connected to the flexible sheet material.

7. The cover according to claim 6, comprising a connecting member attached to the flexible sheet material, wherein the reinforcing mesh is attached to the connecting member to indirectly connect the reinforcing mesh to the flexible sheet material.

8. The cover according to claim 7, wherein the connecting member comprises a woven or fabric material.

9. The cover according to claim 1, comprising a reinforcing fabric extending over intersections between the upper panel and each side panel.

10. The cover according to claim 1, wherein each side panel is connected to the upper panel or each side panel is integrally formed with the upper panel.

11. The cover according to claim 1, wherein the reinforcing mesh extends over substantially all of a width of each side panel.

12. The cover according to claim 11, wherein lateral side edge regions of the reinforcing mesh of each side panel comprise a mesh of increased thickness.

13. The cover according to claim 1, wherein each side panel defines a height extending from the edge of the upper panel to a distal edge of said side panel, and wherein the reinforcing mesh extends partially or entirely along said height.

14. The cover according to claim 1, wherein the reinforcing mesh defines an array of apertures, and wherein a maximum spacing between opposing sides of each aperture is less than 4 cm.

15. The cover according to claim 1, wherein the reinforcing mesh is formed from a flexible material.

16. The cover according to claim 1, wherein each side panel comprises at least one mounting aperture at a distal region of each side panel for receiving a fastener therethrough, and wherein the reinforcing mesh extends over said distal region of each side panel.

17. The cover according to claim 1, comprising a base cover releasably connected to each side panel.

18. The cover according to claim 1, wherein the flexible sheet material is a fabric material.

19. The cover according to claim 1, wherein the flexible sheet material is a breathable and/or water resistant material.

20. A cover for covering goods supported on a base platform, the cover comprising:

an upper panel; and a plurality of side panels each extending from an edge of the upper panel to define an enclosure surrounded by said plurality of side panels, wherein each side panel is formed from a flexible sheet material, and comprises an inner and an outer layer of the flexible sheet material, wherein each side panel comprises a reinforcing mesh extending at least partially over an area defined by the sheet material and arranged between the inner and outer layers, and wherein each side panel comprises one or more regions where the reinforcing mesh is moveable relative to the inner and outer layers of flexible sheet material in a direction extending between the inner and outer layers of flexible sheet material.

* * * * *